US009908247B2

(12) United States Patent
Herlitz

(10) Patent No.: US 9,908,247 B2
(45) Date of Patent: Mar. 6, 2018

(54) UTILITY KNIFE WITH ACTUATOR HANDLE

(71) Applicant: Martin Herlitz, Remscheid (DE)

(72) Inventor: Martin Herlitz, Remscheid (DE)

(73) Assignee: MARTOR KG, Solingen (DE)

( * ) Notice: Subject to any disclaimer, the term of this patent is extended or adjusted under 35 U.S.C. 154(b) by 91 days.

(21) Appl. No.: 14/370,086

(22) PCT Filed: Jan. 29, 2013

(86) PCT No.: PCT/DE2013/000048
§ 371 (c)(1),
(2) Date: Jul. 1, 2014

(87) PCT Pub. No.: WO2013/110264
PCT Pub. Date: Aug. 1, 2013

(65) Prior Publication Data

US 2014/0366385 A1 Dec. 18, 2014

(30) Foreign Application Priority Data

Jan. 29, 2012 (DE) ..... 10 2012 001 491

(51) Int. Cl.
*B26B 1/08* (2006.01)
*B26B 5/00* (2006.01)

(52) U.S. Cl.
CPC ..... *B26B 5/001* (2013.01); *B26B 1/08* (2013.01)

(58) Field of Classification Search
CPC ..... B26B 5/001; B26B 1/08
USPC ..... 30/160–162, 335, 2, 151, 329
See application file for complete search history.

(56) References Cited

U.S. PATENT DOCUMENTS 4,683,656 A * 8/1987 Peyrot ..... B26B 5/003 30/151
6,813,833 B2 * 11/2004 Saunders ..... B26B 5/003 30/125
7,322,110 B2 * 1/2008 Hernandez ..... B26B 5/003 30/162
8,752,297 B2 6/2014 Rohrbach
2007/0209209 A1 * 9/2007 Davis ..... A45F 5/02 30/162

(Continued)

FOREIGN PATENT DOCUMENTS

DE 202004011913 A 11/2004
DE 102009051433 A 5/2011

*Primary Examiner* — Ghassem Alie
*Assistant Examiner* — Nhat Chieu Do
(74) *Attorney, Agent, or Firm* — Andrew Wilford

(57) ABSTRACT

A utility knife has a housing, a blade support adapted to carry a blade and shiftable in the housing between a cutting position in which the blade projects from the housing and a safety position in which the blade is retracted into the housing, and a handle pivotal on the housing from a starting position in a first direction into an open position in which the blade in the support can be replaced and from the starting position in a second direction opposite the first direction into an active position operatively engaging the blade support and displacing same into the cutting position. An actuation element is movable on the housing between a first position blocking movement of the handle into the open position and a second position blocking movement of the support into the cutting position.

15 Claims, 8 Drawing Sheets

(56) References Cited

U.S. PATENT DOCUMENTS

2010/0319200 A1* 12/2010 Davis ..... B26B 5/003
30/162

* cited by examiner

UTILITY KNIFE WITH ACTUATOR HANDLE

CROSS REFERENCE TO RELATED APPLICATIONS

This application is the US-national stage of PCT application PCT/DE2013/000048 filed 29 Jan. 2013 and claiming the priority of German patent application 102012001491.0 itself filed 29 Jan. 2012.

FIELD OF THE INVENTION

The invention relates to a knife, more particularly a utility knife with a replaceable blade.

BACKGROUND OF THE INVENTION

A knife of this type is well known based on public prior use as disclosed by the applicant. The knife has a housing that together with a handle forms a pivot joint. The handle can be moved relative to the housing between a starting position and an active position. The knife furthermore has a blade support movable between a safety position and a cutting position. When in the cutting position, the blade projects from an opening of the housing and cutting can be done. In the safety position, the blade is inaccessible to the user. When the handle is in the starting position, the blade is in the safety position. When the handle is moved to the active position, the blade support moves to the cutting position. Relative movement of the handle and the housing enables the handle to be removed from the housing and provides access to the blade support allowing the blade to be replaced.

The blade has a safety device comprising a first latch that can prevent movement by the handle between the starting position and the active position. The safety device furthermore has a second latch that prevents removal of the housing from the handle, and thus unintended access to the blade, in the safety position.

OBJECT OF THE INVENTION

The object of the invention is therefore to create a knife that can be manufactured by simple and cost-effective means.

SUMMARY OF THE INVENTION

This object is attained by a knife according to the invention having a blade support carrying a blade supported so as to be movable between a safety position and a cutting position. The blade is inside the housing and is inaccessible when the blade support is in the safety position. The blade support can be shifted to a cutting position by moving the handle to an active position relative to the housing. The blade can be replaced when the housing is moved to an open position. The housing for example has two housing components that can be moved between a closed position and an open position. The handle for example can form the housing together with another housing component. The handle can be moved for example relative to the housing between a starting position, an active position, and an open position.

A safety device enables any movement to be prevented by the blade support out of the safety position into the cutting position. For example, movement by the blade support to the cutting position can be prevented by blocking movement of the handle relative to the housing. Once in the blocked position it is impossible for the handle to be shifted from the starting position to the active position.

According to the invention, the safety device has an actuation element that can move the safety device into at least two positions. The actuation element is for example on the housing. Alternatively, the actuation element can, on the other hand, also be on the handle. Movement by the knife to an open position is blocked in a first position, while movement into the cutting position is blocked in the second position. Movement into the cutting position is prevented for example by blocking movement of the handle. The knife can be moved for example into three positions. Movement by the knife to the open position is prevented in the first position, movement into the cutting position is prevented in a second position, while movement into the open position is allowed in a third position.

Movement into the cutting position can be blocked for example in the first position. Movement into the open position can additionally be blocked for example in the second position. Furthermore, movement into the cutting position is additionally blocked in the third position.

One embodiment is characterized in that the actuation element moves synchronously with a blocking element. The blocking element can for example be unitarily formed with the actuation element. In one alternative, the blocking element is permanently fixed for example to the actuation element. In another alternative, the blocking element is connected indirectly to the actuation element. The safety device can be designed for example in such a way that a position of the blocking element is associated with each position of the actuation element.

Another embodiment is characterized in that the actuation element and/or the blocking element are in a detent seat in at least one position of the safety device. For example, the blocking element or the actuation element engages a detent seat in the first position and the second position, and optionally in other positions. The travel path for the blocking element for example is constricted between the detent seats, with the result that the blocking element must be elastically deformed when moving from one detent seat to another detent seat.

The movement of the blade support into the cutting position can be prevented for example by a releasable latch of the handle. Whenever movement of the handle into the starting position is blocked so that the handle cannot be moved to the active position, movement into the cutting position by the blade support is also impossible.

The actuation element is for example a slide supported so as to be movable at least between a first position and a second position. The slide can be shifted in position by a straight-line movement.

The actuation element is mounted for example on the housing. Alternatively, the actuation element can for example also be mounted on the handle.

For example, the handle has a recess and the blocking element in at least one position of the safety device can drop into this recess of the handle whenever the handle is moved to the active position. The recess is a slot.

In another embodiment of the invention, the latch is formed by at least one stop face of the handle or the housing. In the second position of the safety device for example the blocking element is between confronting blocking faces. The blocking element is for example on the housing, while the blocking faces are for example on the handle.

BRIEF DESCRIPTION OF THE DRAWING

Additional advantages of the invention are seen in the embodiment shown in the figure. Therein.

SPECIFIC DESCRIPTION OF THE INVENTION

Figure 1:
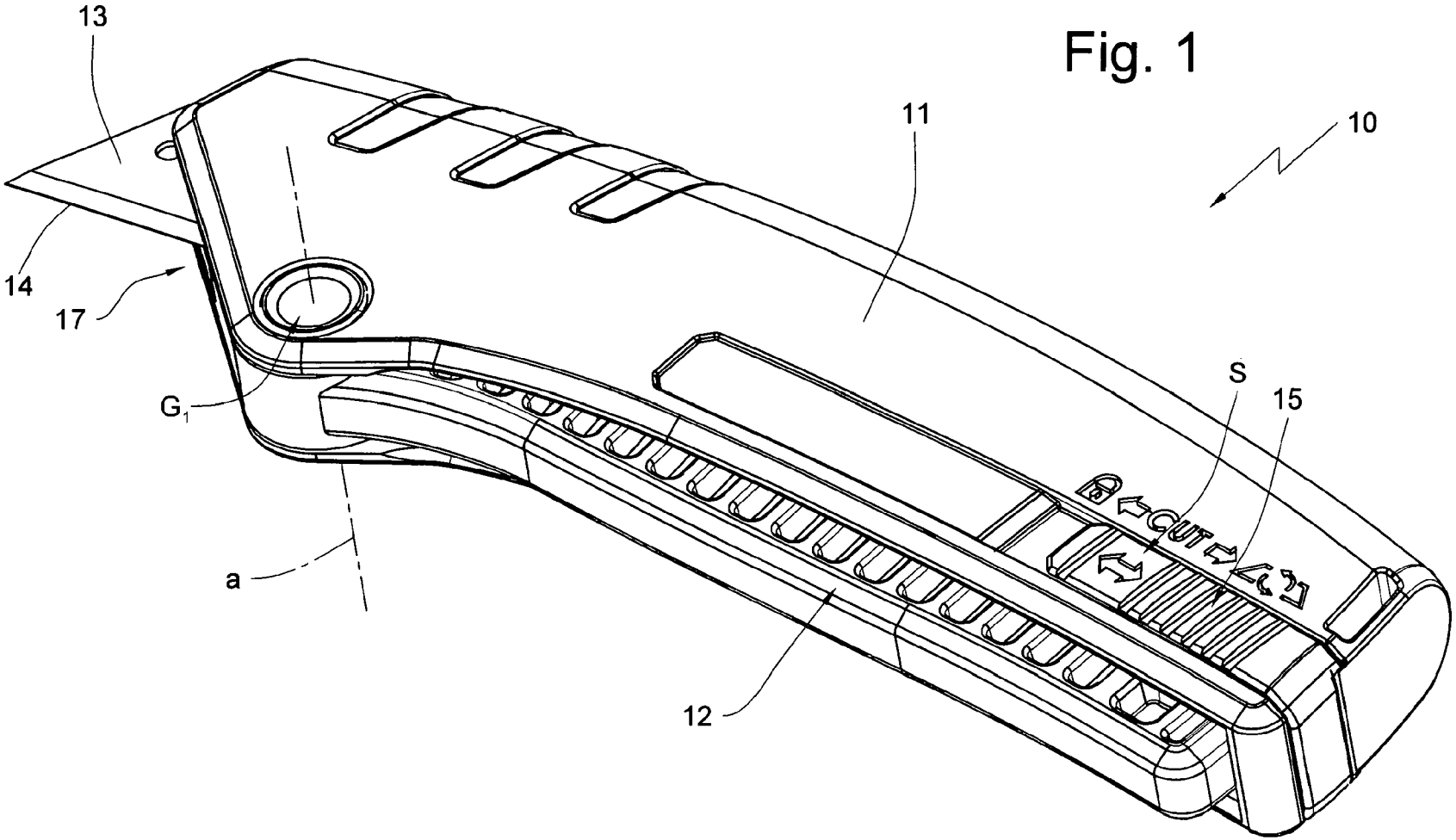
FIG. 1 is a schematic perspective view of the knife according to the invention.

The knife in its entirety is shown at 10. Identical reference characters in the various figures also identify identical parts, including wherever lower-case letters are added or omitted.

FIG. 1 is a perspective view of the knife 10. The knife 10 has a housing 11 and a handle 12. The handle 12 together with a pivot joint G1 define a pivot axis a. The handle 12 in FIG. 1 is in an active position so the knife 10 is in a cutting position in which a blade 13 together with its cutting edge 14 project from an opening 17 in the housing 11 and cutting can then be done.

Figure 2:
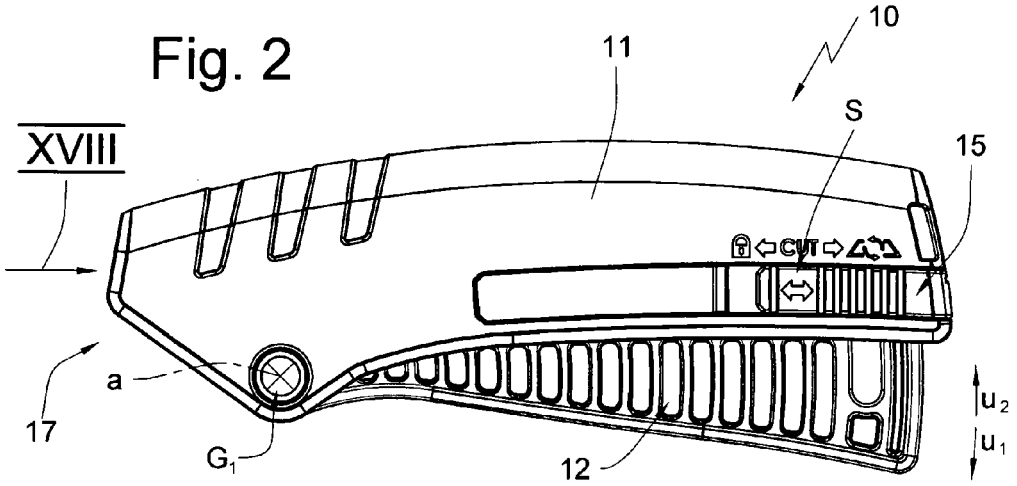
FIG. 2 is a schematic side view of the knife in the safety position where the safety device is in a first position.

The knife 10 has a safety device S having an actuation element 15. The safety device S in FIGS. 1 through 7 is shown in a first position. FIG. 2 shows the handle 12 in the starting position into which it has been pivoted in a first direction $u_1$ from the active position shown in FIGS. 1 and 5.

Figure 3:
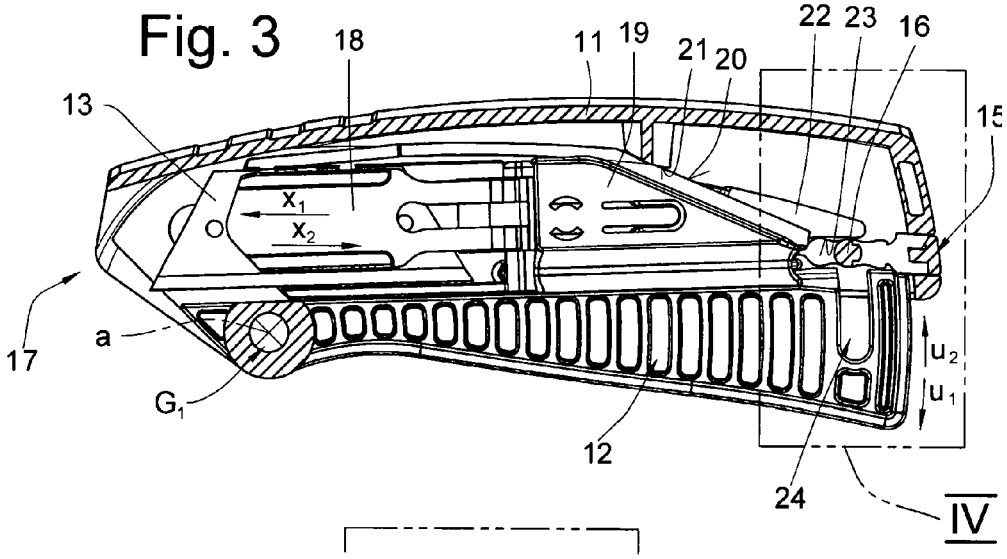
FIG. 3 is a schematic longitudinal section through the knife taken along section line III-III of FIG. 18.
Figure 4:
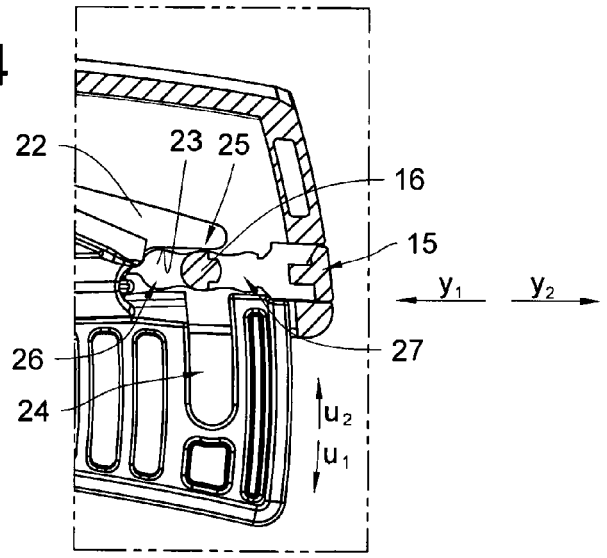
FIG. 4 is a detail shown at IV in FIG. 3.
Figure 5:
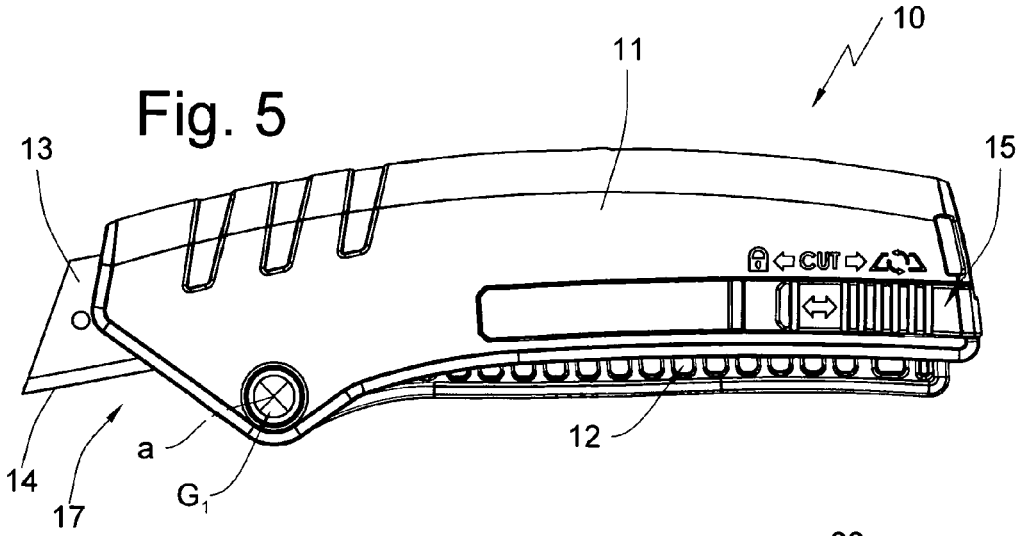
FIG. 5 is a schematic side view of the knife in the cutting position.
Figure 6:
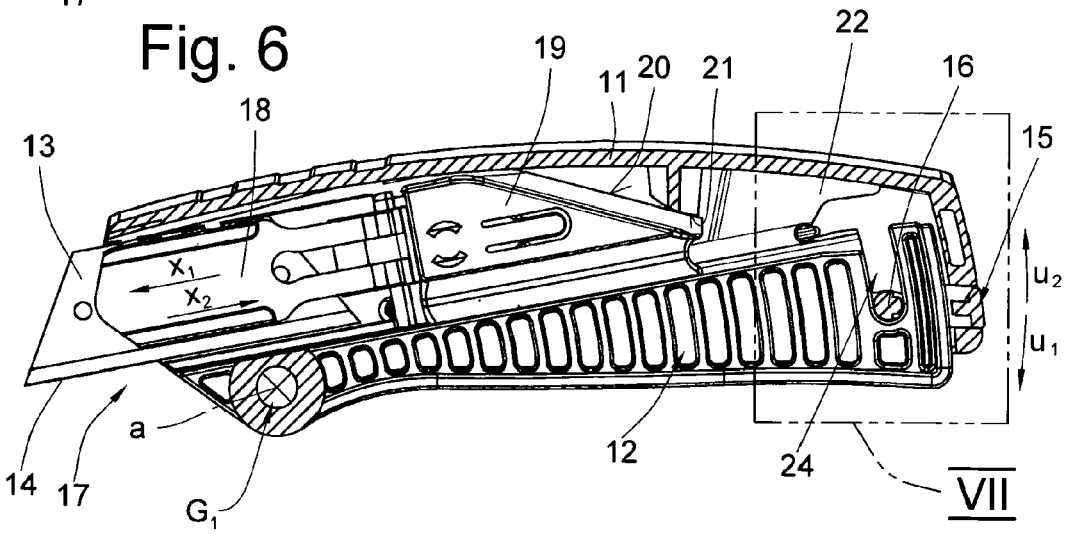
FIG. 6 is a schematic longitudinal view of the knife as in FIG. 5.
Figure 7:
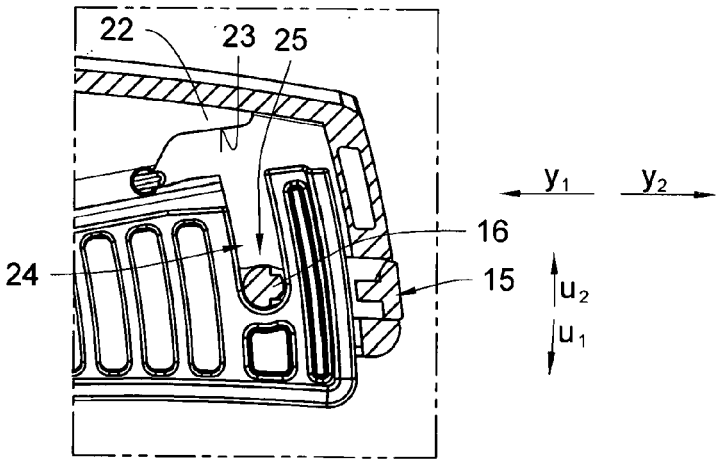
FIG. 7 is a detail shown at VII in FIG. 6.

FIG. 3 shows how the blade 13 is supported in a blade support 18. The blade support 18 is connected to an actuator 19 provided with an angled face 20. When the handle 12 is pivoted from the starting position shown in FIG. 3 in a second direction $u_2$, the angled face 20 interacts in the known manner with an opposing face 21 of the housing 11, with the result that the blade support 18 is cammed in a direction $x_1$ toward the cutting position shown for example in FIGS. 1, 5 and 6. At the same time the opposite face 21 slides along the angled face 20 (see FIGS. 3 and 6).

Once the pressure on the handle 12 in the cutting position has been released, the blade support 18 is moved by an unillustrated spring in a direction $x_2$ back into the safety position shown in FIGS. 2 and 3. At the same time the handle 12 is pivoted from the active position of FIG. 6 in the first direction $u_1$ back to the starting position of FIG. 3.

FIG. 3 shows that the handle 12 has an extension 22 having a stop face 23. The handle 12 also has a slot 24. FIG. 3 furthermore shows a bar 16 associated with the safety device S and permanently fixed to the actuation element 15. The housing 11 has three detent seats 25, 26, and 27 shown in FIG. 4. In the first position of the safety device, the bar 16 is in the detent seat 25. Moving the actuation element 15 from the first position to the second position in direction $y_1$ enables the bar 16 to shift from the detent seat 25 to the detent seat 26. Moving the actuation element 15 from the first position to the third position in direction $y_2$ shifts the bar 16 from the detent seat 25 to the detent seat 27. The travel path for the bar 16 between the detent seats 25, 26, and 27 is constricted so that the bar 16 must be elastically deformed in order to pass from one detent seat to another detent seat. The elastic deformation is only possible by exceeding a minimum force.

Movement by the handle 12 in the first direction $u_1$ is impossible in the first position in the seat 25 since the bar 16 mounted in the housing 11 is in the travel path for the stop face 23. Movement in the direction $u_2$ is possible, however, because of slot 24 into which the bar 16 can drop when the handle 12 is moved in direction $u_2$ from the starting position to the active position (see for example FIGS. 6 and 7). The handle 12 can thus be moved to the active position to shift the blade support 18 into the cutting position.

Figure 8:
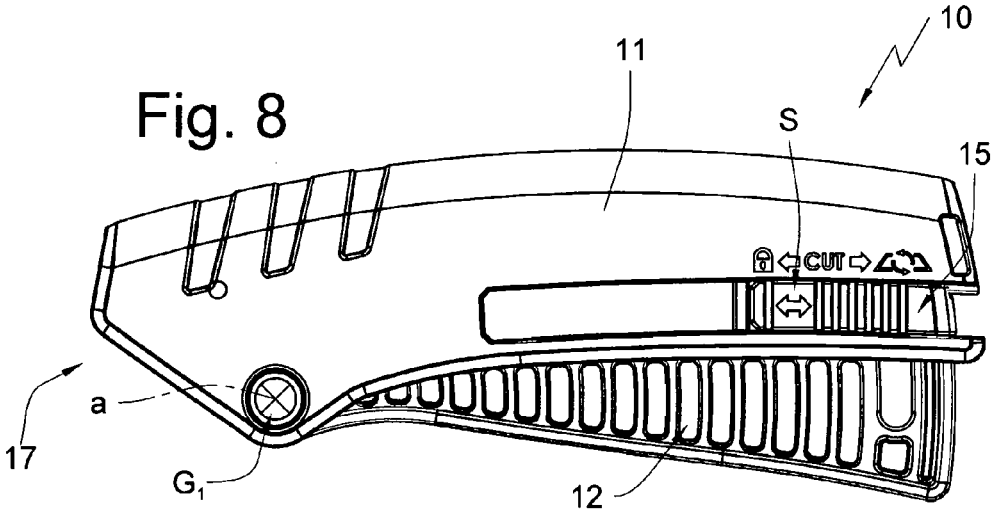
FIG. 8 is a schematic side view of the knife in the safety position with the safety device in a second position.
Figure 9:
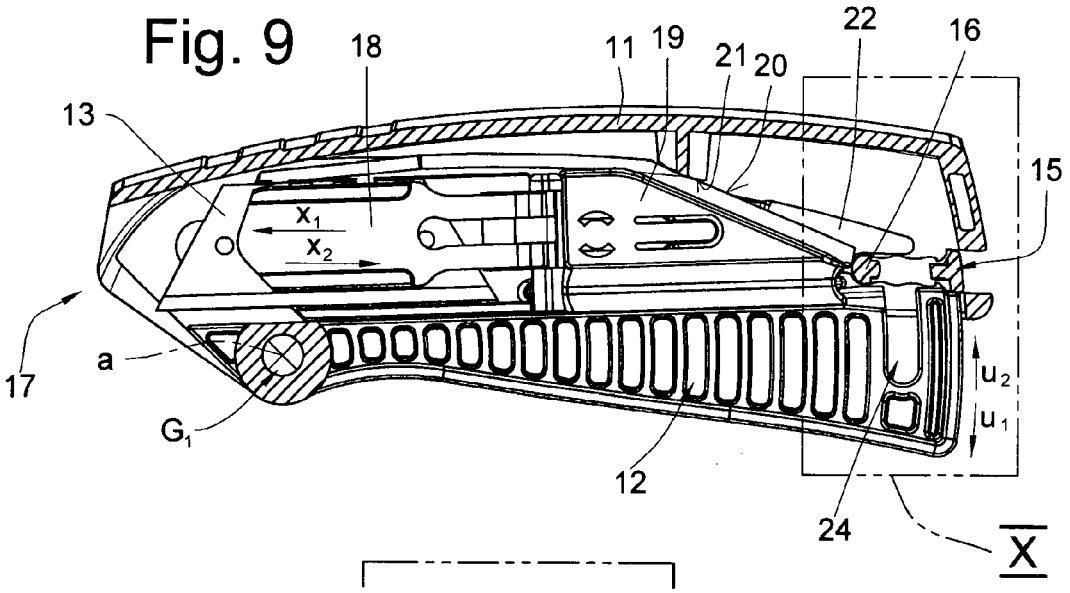
FIG. 9 is a schematic longitudinal section through the knife as in FIG. 8.
Figure 10:
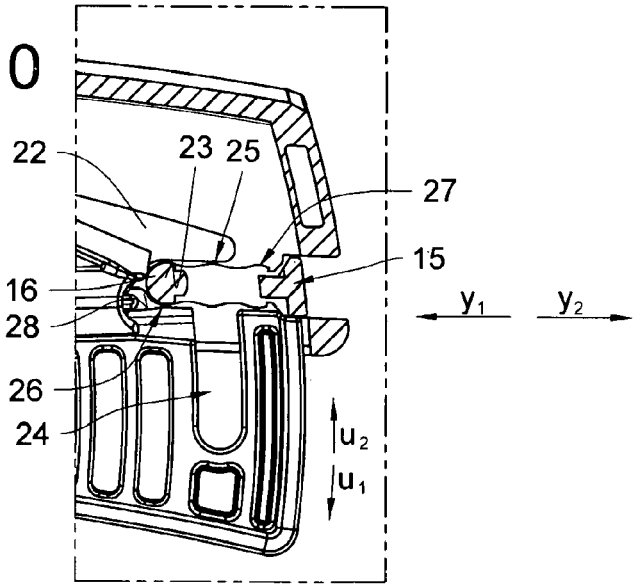
FIG. 10 is an enlarged detail shown at X in FIG. 9.

The actuation element 15 in FIG. 8 is in the second position. FIG. 9 shows how the bar 16 is in the detent seat 26. The bar 16 is in the travel path for the stop face 23, with the result that the handle 12 cannot be pivoted in the direction $u_1$ toward an open position from the starting position shown in FIGS. 8 and 9. In addition, the handle 12 also cannot be pivoted in the direction $u_2$ to the active position since the bar 16 is in the travel path for an opposite stop face 28 (see FIG. 10) of the handle 12. Whenever the handle 12 tries to move from the starting position in the direction $u_2$, the stop face 28 immediately strikes the bar 16 and pivoting in the direction $u_2$ is prevented. The blade 13 can therefore not emerge from the housing 11 into the cutting position when the safety device S is in the second position.

Figure 11:
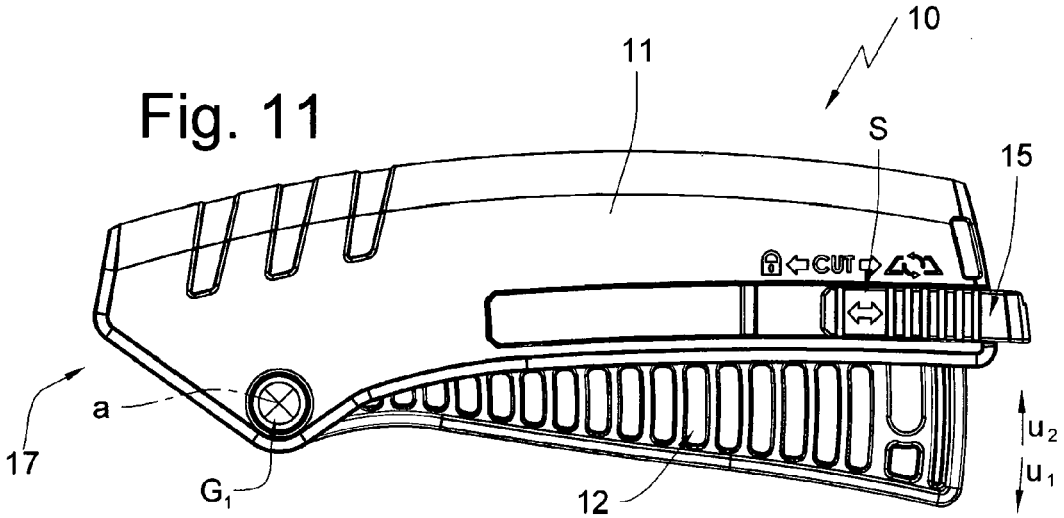
FIG. 11 is a schematic side view of the knife in the safety position with the safety device in a third position.
Figure 12:
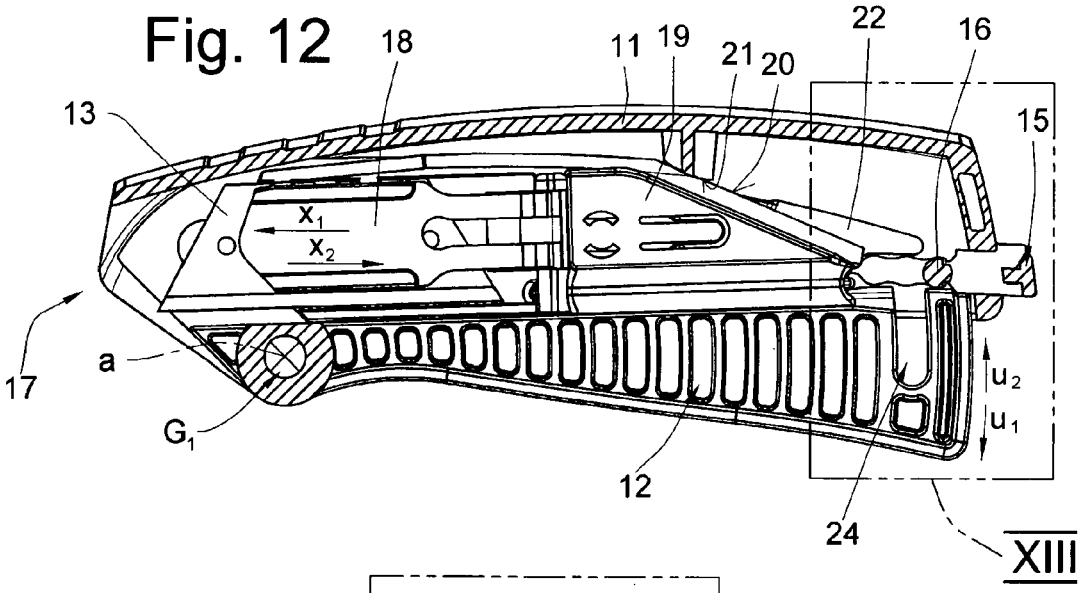
FIG. 12 is a longitudinal section through the knife as in FIG. 11.
Figure 13:
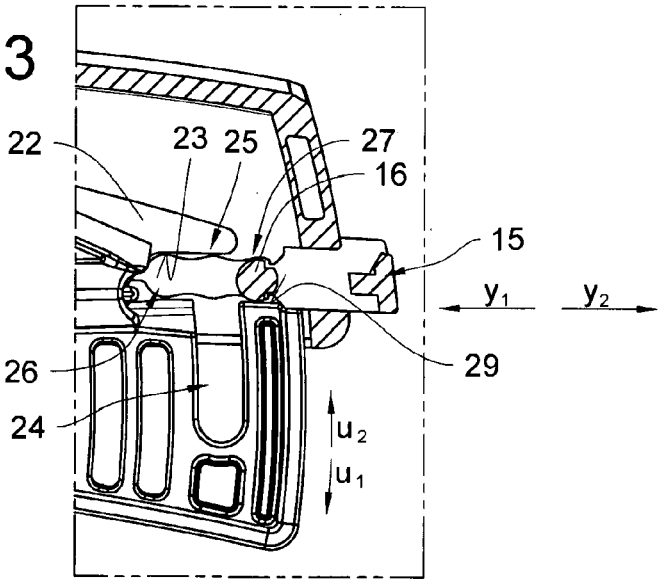
FIG. 13 is a schematic detail as shown at XIII in FIG. 12.

FIGS. 11 through 17 show the safety device S of the knife 10 in the third position. The handle 12 in FIG. 11 is in the starting position. Shifting the actuation element 19 from the first position in the direction $y_2$ enables the third position to be set for the safety device. The bar 16 is in the detent seat 27 when the safety device S is in the third position.

Moving the handle 12 relative to the housing 11 from the starting position shown in FIG. 11 in the direction $u_2$ to the active position is impossible when the safety device is in the third position since the bar 16 is in the travel path blocking another stop face 29 of the handle 12. When the handle 12 moves in the direction $u_2$, the stop face 29 immediately comes into contact with the bar 16, thereby preventing the blade 13 from moving out of the safety position into the cutting position. Movement of the handle 12 in the opposite direction $u_1$ is possible, on the other hand, since the bar 16 is not in the travel path for the handle 12, in particular, in the travel path for the extension 22. The handle 12 can therefore be moved in the direction $u_1$ relative to the housing 11 from the starting position in FIG. 11 to an open position.

Figure 14:
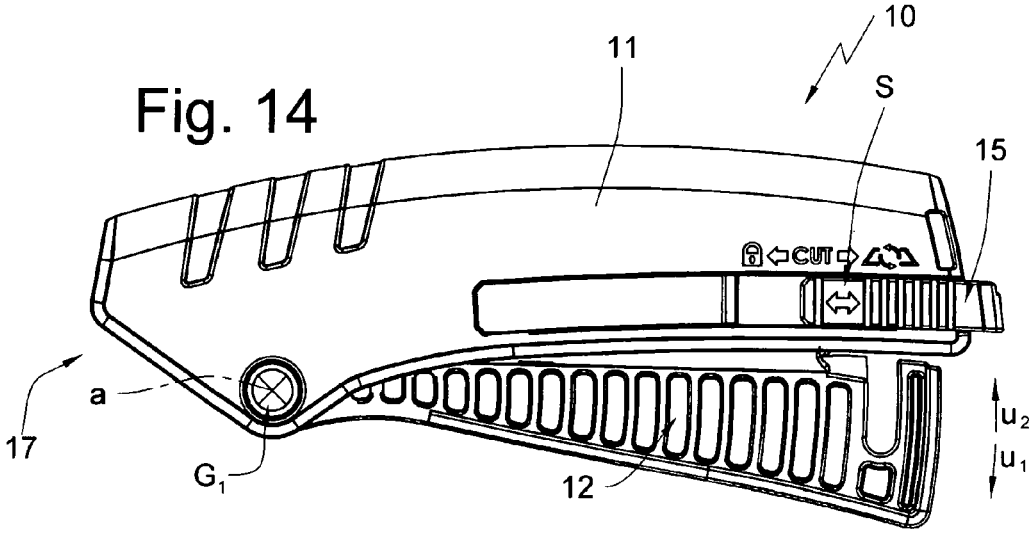
FIG. 14 is a schematic side view of the knife with the safety device in a third position and with the handle pivoted from the starting position toward an open position.
Figure 15:
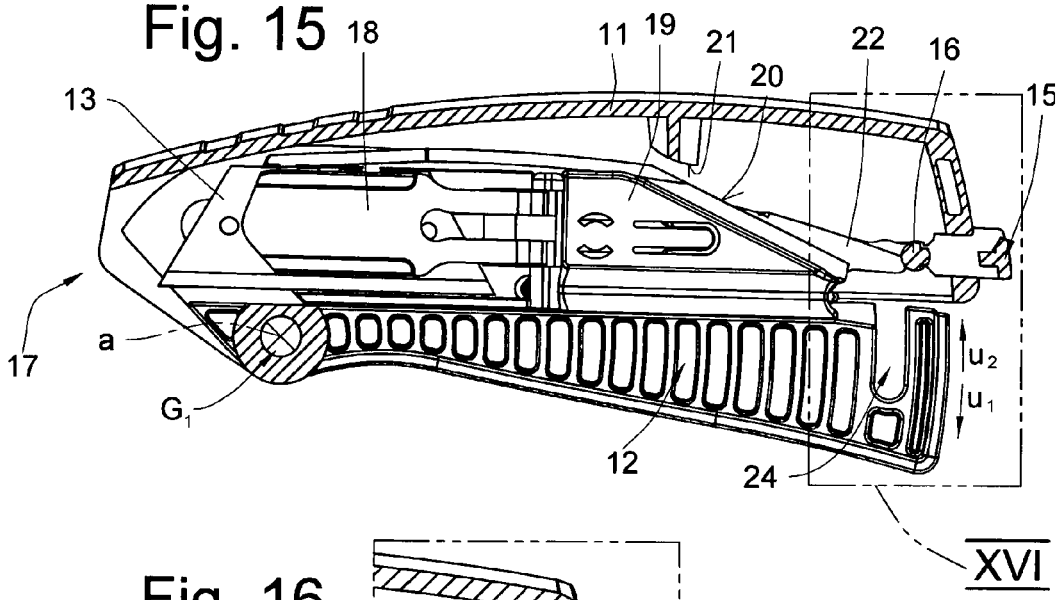
FIG. 15 is a schematic section through the knife as in FIG. 14.
Figure 16:
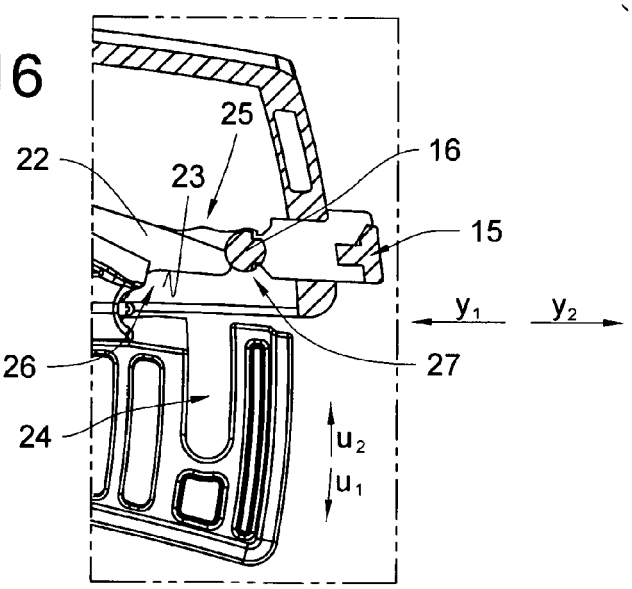
FIG. 16 is a schematic enlarged detail as shown at XVI in FIG. 15.

FIGS. 14 through 16 show the handle 12 in an intermediate position between the starting position and the open position. These show that the extension 22 can move past the bar 16.

Figure 17:
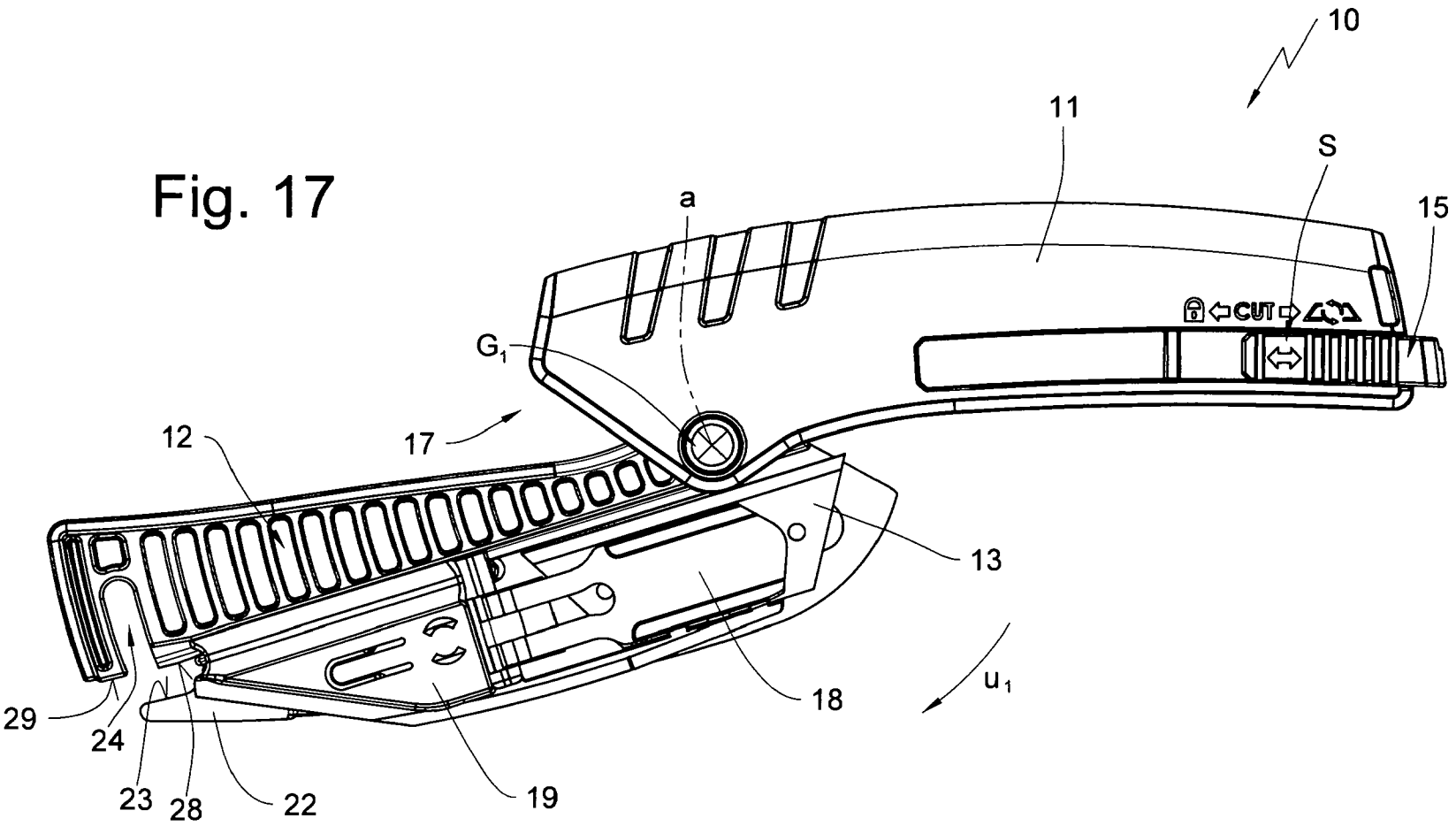
FIG. 17 is a schematic side view of the knife in the open position.
Figure 18:
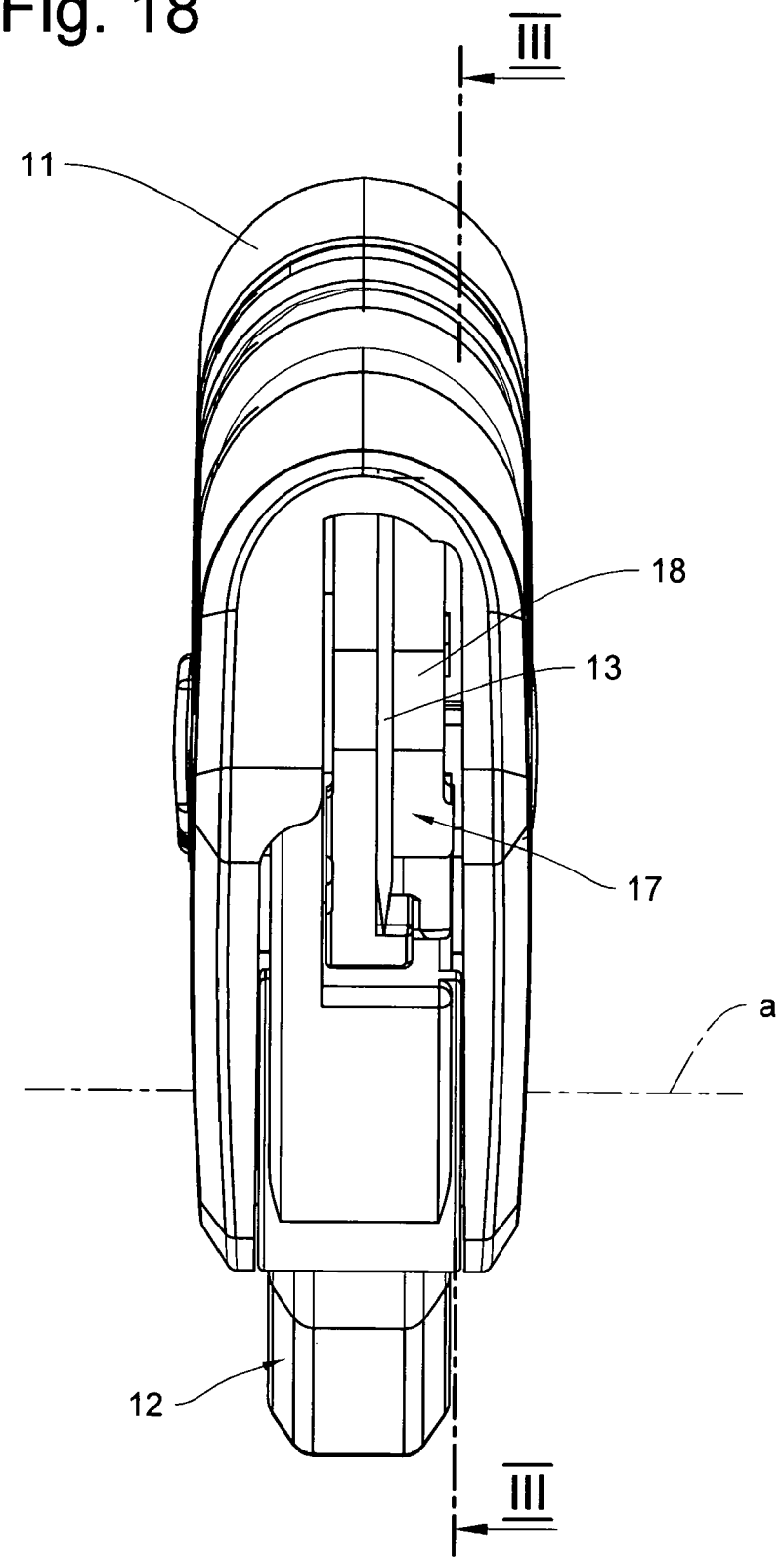
FIG. 18 is a schematic front view of the knife as shown by arrow XVIII in FIG. 2.

The open position of the handle 12 is shown in FIG. 17. The open position allows the blade 13 to be removed from the blade support 18 and replaced with another blade.

From the open position, the handle 12 can be moved back by pivoting in the direction $u_2$ to the starting position. Moving the actuation element 15 in the direction $y_1$ to the first position of the safety device once again enables cutting to be done.

The invention claimed is:

1. A utility knife comprising:

a housing;

a blade support adapted to carry a blade and shiftable relative to the housing between a cutting position in which the blade projects from the housing and a safety position in which the blade is retracted into the housing and access to the blade support is prevented;

a handle pivotal on the housing from a starting position in a first direction into an open position in which the blade support is accessible and the blade in the support can be replaced and from the starting position in a second direction opposite the first direction into an active position operatively engaging the blade support and displacing same into the cutting position; and an actuation element movable on the housing between a first position blocking movement of the handle into the open position and allowing movement of the handle into the active position, a second position blocking movement of the support into the cutting position.

2. The knife according to claim 1, wherein the actuation element moves synchronously with a blocking element.

3. The knife according to claim 2, wherein the blocking element in at least one position of the actuation element is in a detent seat.

4. The knife according to claim 2, wherein the handle has a recess and in the first position of the actuation element the blocking element is engageable into the recess of the handle when the handle is moved from the starting position to the active position.

5. The knife according to claim 2, wherein the handle is formed with confronting stop faces and in the second position the blocking element is between the stop faces.

6. The knife according to claim 1, wherein the actuation element is a slide supported so as to be movable between the first position and the second position.

7. The knife according to claim 1, wherein the actuation element is supported on the housing.

8. The knife according to claim 1, wherein the handle is formed by at least one stop face engageable with the actuation element.

9. The utility knife defined in claim 1, wherein the actuation element also blocks movement of the handle into the open position in the second position.

10. The utility knife defined in claim 1, wherein the actuation element is movable into a third position allowing movement of the handle only into the open position.

11. The utility knife defined in claim 10, wherein the actuation element blocks movement of the handle into the active position in the third position of the actuation member.

12. The utility knife defined in claim 10, wherein the first position is between the second and third positions.

13. The utility knife defined in claim 1, wherein the blade holder is coupled to and pivotal with the handle, the blade holder being inside the housing in the safety and cutting positions and being outside the housing and exposed in the open position.

14. A utility knife comprising:

a housing;

a blade support adapted to carry a blade and shiftable relative to the housing between a cutting position in which the blade projects from the housing and a safety position in which the blade is retracted into the housing;

a handle pivotal on the housing from a starting position in a first direction into an open position in which the blade in the support can be replaced and from the starting position in a second direction opposite the first direction into an active position operatively engaging the blade support and displacing same into the cutting position, the blade support being movable on the handle; and an actuation element movable on the housing between a first position blocking movement of the handle into the open position and allowing movement of the handle into the active position, and a second position blocking movement of the support into the cutting position and also blocking movement of the handle into the open position.

15. A utility knife comprising:

a housing;

a blade support adapted to carry a blade and shiftable relative to the housing between a cutting position in which the blade projects from the housing and a safety position in which the blade is retracted into the housing;

a handle pivotal on the housing from a starting position in a first direction into an open position in which the blade in the support can be replaced and from the starting position in a second direction opposite the first direction into an active position operatively engaging the blade support and displacing same into the cutting position, the blade support being movable on the handle; and an actuation element movable on the housing between a first position blocking movement of the handle into the open position and allowing movement of the handle into the active position, and a second position blocking movement of the handle into the active position and also blocking movement of the handle into the open position.

* * * * *